US012534251B2

(12) United States Patent
Caporale et al.

(10) Patent No.: US 12,534,251 B2
(45) Date of Patent: Jan. 27, 2026

(54) APPARATUS AND METHOD FOR PACKAGING PACKETS OF SMOKING ARTICLES

(71) Applicant: I.M.A. INDUSTRIA MACCHINE AUTOMATICHE S.P.A., Ozzano Dell'emilia (IT)

(72) Inventors: Antonio Caporale, Ozzano Dell'emilia (IT); Loris Sacrati, Ozzano Dell'emilia (IT)

(73) Assignee: I.M.A. INDUSTRIA MACCHINE AUTOMATICHE S.P.A., Ozzano Dell'emilia (IT)

( * ) Notice: Subject to any disclaimer, the term of this patent is extended or adjusted under 35 U.S.C. 154(b) by 0 days.

(21) Appl. No.: 18/702,033

(22) PCT Filed: Nov. 15, 2022

(86) PCT No.: PCT/IT2022/050294
§ 371 (c)(1),
(2) Date: Apr. 17, 2024

(87) PCT Pub. No.: WO2023/084554
PCT Pub. Date: May 19, 2023

(65) Prior Publication Data

US 2025/0011023 A1 Jan. 9, 2025

(30) Foreign Application Priority Data

Nov. 15, 2021 (IT) ..... 102021000028871

(51) Int. Cl.
*B65B 51/02* (2006.01)
*B65B 19/22* (2006.01)

(52) U.S. Cl.
CPC ..... *B65B 51/023* (2013.01); *B65B 19/226* (2013.01); *B65B 2230/04* (2013.01)

(58) Field of Classification Search
CPC . B65B 19/223; B65B 19/226; B65B 2230/04; B65B 51/023; B65B 51/14; B65B 57/00; B65B 61/002
See application file for complete search history.

(56) References Cited

U.S. PATENT DOCUMENTS 6,286,291 B1 * 9/2001 Tale' ..... B65B 19/225 53/579
6,625,957 B2 * 9/2003 Spatafora ..... B65B 19/20 53/462

(Continued)

FOREIGN PATENT DOCUMENTS

DE 102020115597 A1 12/2020
EP 0844181 B1 8/2001
EP 3172133 B1 5/2019

OTHER PUBLICATIONS

International Search Report filed in PCT/IT2022/050294 dated Mar. 30, 2023.

*Primary Examiner* — Himchan Song
(74) *Attorney, Agent, or Firm* — RANKIN, HILL & CLARK LLP

(57) ABSTRACT

An apparatus for packaging packets for smoking articles includes a transfer wheel to transfer the packets from a feed device to an outlet device. A gluing device is disposed in a certain angular position between the feed device and the outlet device to selectively glue two lateral flaps of each packet on the corresponding lateral walls thereof. A pressing device is disposed outside the transfer wheel between the gluing device and the outlet device to press the lateral flaps of the packet against corresponding lateral walls thereof.

11 Claims, 6 Drawing Sheets

(56) References Cited

U.S. PATENT DOCUMENTS

| | | | | |
|---|---|---|---|---|
| 2004/0231297 | A1* | 11/2004 | Spatafora | B65B 19/225 53/461 |
| 2008/0047226 | A1* | 2/2008 | Corsini | B65B 19/20 53/234 |
| 2011/0041463 | A1* | 2/2011 | Squarzoni | B65D 85/1054 53/461 |
| 2015/0336697 | A1* | 11/2015 | Cavazza | B65B 61/002 53/564 |
| 2020/0002034 | A1* | 1/2020 | Polloni | B65B 19/20 |
| 2023/0173781 | A1* | 6/2023 | Carboni | B65B 51/023 493/128 |

* cited by examiner

APPARATUS AND METHOD FOR PACKAGING PACKETS OF SMOKING ARTICLES

FIELD OF THE INVENTION

The present invention concerns an apparatus and a method for packaging packets of smoking articles, such as, for example, but not exclusively, cigarettes.

BACKGROUND OF THE INVENTION

Various apparatuses are known for packaging packets of smoking articles, for example cigarettes, which comprise a feed device able to feed the packets to be packaged, or already partly packaged, in sequence toward a transfer wheel, on which the packets are subjected to at least another processing step, for example gluing, and an outlet or pick-up device, which picks up the packets from the transfer wheel and sends them to a possible subsequent processing station.

In particular, a machine for packaging cigarettes is known from patent application US 2004/0231297, in which the transfer wheel is continuously rotatable around an axis of rotation and comprises a plurality of seatings disposed on the periphery of the wheel to receive respective packets to be packaged. The packets pass through a gluing station before reaching a folding station. In the gluing station there are two hot gluing devices and two cold gluing devices, each of these devices is disposed in a predetermined fixed position and is configured to deposit spots of glue, respectively hot and cold, to form a layer of adhesive on the internal surface of the external longitudinal flaps, which are still in the open position, and which will be taken to the closed position when they subsequently pass through the folding station.

Furthermore, an apparatus is known from European patent EP3172133, granted to the present Applicant, for packaging packets of smoking articles in which the transfer wheel is rotatable around an axis of rotation and comprises a plurality of seatings disposed on the periphery to sequentially receive the packets from the feed device and to move them with a stepwise advance along a curved path between the latter and the outlet device.

In each of these seatings, an already partly packaged packet, with a certain number of cigarettes inside it, is positioned so that its longitudinal walls are parallel to the axis of rotation of the transfer wheel and corresponding lateral flaps are open.

A gluing device is associated with the transfer wheel which, while the wheel is stationary, selectively lays a glue between the internal longitudinal flaps and the corresponding external lateral flaps of a packet, performing a movement parallel to said axis of rotation.

Although it is very reliable and functional, this known apparatus has the disadvantage however that it does not allow high hourly productions, precisely due to the fact that each gluing step, which lasts several hundred milliseconds (ms), takes place while the transfer wheel is stationary.

There is therefore a need to perfect an apparatus for packaging packets of smoking articles which can overcome at least the above disadvantage of the state of the art, while at the same time solving the technical problem of gluing together the internal longitudinal flaps and the corresponding external lateral flaps of a packet, reducing the time of each cycle as much as possible, in order to achieve a high hourly production, for example in the order of over 30,000 packets.

Therefore, one purpose of the present invention is to provide an apparatus and perfect a method for packaging packets of smoking articles, which is simple and reliable and which at the same time allows to reach a high hourly productivity, as indicated above, solving the technical problem as above.

Another purpose of the present invention is to provide an apparatus and perfect a method for packaging packets of smoking articles, which glues the internal longitudinal flaps and the corresponding external lateral flaps of each packet, depositing the adhesive material in a disposition chosen as desired, for example substantially rectilinear, that is, parallel to an edge of the longitudinal walls.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, and to resolve the technical problem disclosed above in a new and original way, also achieving considerable advantages compared to the state of the prior art, an apparatus according to the present invention for packaging packets of smoking articles, wherein each of the packets comprises a box-like body having at least two opposite lateral walls, each lateral wall being formed by at least one respective internal flap and at least one external flap, which are overlapping each other and glued together, comprises:

- a transfer wheel selectively rotatable around a first axis of rotation and configured to move the packets along an arcuate transfer path, wherein the transfer wheel circumferentially comprises a peripheral surface provided with a plurality of seatings, each of which is configured to temporarily hold one of the packets along the transfer path;
- a feed device disposed in a first fixed angular position with respect to the transfer wheel at the beginning of the transfer path and configured to individually feed packets to be glued toward the seatings;
- an outlet device disposed in a second fixed angular position with respect to the transfer wheel at the end of the transfer path and configured to receive the packets, after they have been glued, from the transfer wheel;
- a gluing device disposed outside the transfer wheel in an intermediate angular position between the feed device and the outlet device and configured to selectively deliver a glue on the packets to be glued.

In accordance with one aspect of the present invention, each of the seatings is oriented so that, in the seating, a respective packet to be glued is disposed along the transfer path with the respective internal flaps of each lateral wall disposed perpendicular to the first axis of rotation, and the apparatus also comprises a movement device configured to move the gluing device along a path substantially radial with respect to the transfer wheel, taking the gluing device closer to, or away from, the peripheral surface, in coordination with the rotation of the transfer wheel, in order to deliver the glue on at least one of either the internal flap or the corresponding external flap of each lateral wall of the packet to be glued, when the latter passes in front of the gluing device, the movement of the gluing device being adjusted in such a way as to deposit the glue along a programmed disposition while the packet to be glued advances along the transfer path.

Doing so achieves at least the advantage of obtaining an apparatus for packaging packets of smoking articles that is simple and reliable, and that at the same time allows to achieve a high hourly productivity.

In accordance with another aspect of the present invention, the programmed disposition is substantially rectilinear and parallel to an edge of the lateral walls, and the movement device is capable of compensating for the radial distance that exists at the center of the rectilinear programmed disposition with respect to the arcuate transfer path.

Doing so achieves at least the advantage of obtaining an apparatus for packaging packets of smoking articles that produces a gluing between the internal lateral flaps and the corresponding external lateral flaps of each packet by depositing the adhesive material with a disposition chosen as desired, for example substantially rectilinear, that is, parallel to an edge of the longitudinal walls.

In accordance with another aspect of the present invention, the gluing device is configured to deliver, in a first gluing step, a first quantity of the glue, and then, in a second gluing step, a second quantity of glue.

In accordance with another aspect of the present invention, the gluing device comprises a pair of delivery devices, disposed in the proximity of the peripheral surface, on opposite parts with respect to a transverse plane which is perpendicular to the first axis of rotation and passes approximately halfway through the thickness of the wheel, wherein the delivery devices are convergent toward the transverse plane.

In accordance with another aspect of the present invention, the transfer wheel, the feed device, the outlet device, the gluing device and the movement device are controlled and coordinated by a control unit.

In accordance with another aspect of the present invention, the feed device comprises a feed wheel adjacent to the transfer wheel, substantially tangent thereto and rotatable around a second axis of rotation perpendicular to the first axis of rotation.

In accordance with another aspect of the present invention, each of the seatings is substantially U-shaped and the outlet device comprises at least one pick-up device configured to pick up the packets selectively and sequentially one at a time from the transfer wheel, removing them from the seatings preferably from the bottom upward along a rectilinear path substantially parallel to the first axis of rotation.

In accordance with another aspect of the present invention, the apparatus as above also comprises at least one pressing device disposed outside the peripheral surface in a second intermediate angular position between the gluing device and the outlet device, and configured to selectively press the lateral flaps against the corresponding internal lateral flaps of the packets in order to glue them together.

In accordance with another aspect of the present invention, a method for packaging packets of smoking articles, wherein each of the packets comprises a box-like body having at least two opposite lateral walls, each lateral wall being formed by at least one respective internal flap and at least one external flap, wherein the smoking articles are inserted in the box-like body parallel to the two lateral walls, comprises the following steps: a movement step, in which a transfer wheel, selectively rotatable around a first axis of rotation, is selectively rotated in order to move the packets along an arcuate transfer path, from a feed device, located in a first fixed angular position, to an outlet device, located in a second fixed angular position, and a gluing step in which a gluing device, disposed outside the transfer wheel in an intermediate angular position between the feed device and the outlet device, selectively delivers at least one glue on the packets to be glued. Each packet to be glued is disposed along the transfer path with the respective internal flaps of each lateral wall disposed perpendicular to the first axis of rotation.

During the gluing step, the gluing device is moved along a path substantially radial with respect to the transfer wheel, taking the gluing device closer to, or away from, a peripheral surface of the transfer wheel, in coordination with the rotation of the transfer wheel, in order to deliver the glue between at least each one of the internal lateral flaps and the corresponding external lateral flaps of the packet when the latter passes in front of the gluing device, the movement of the gluing device being adjusted in such a way as to deposit the glue along a programmed disposition while the packet to be glued advances along the transfer path.

In accordance with another aspect of the present invention, the programmed disposition is substantially rectilinear and parallel to an edge of the lateral walls, and the movement device compensates for the radial distance that exists at the center of the rectilinear programmed disposition with respect to the arcuate transfer path.

In accordance with another aspect of the present invention, the gluing device delivers, in a first gluing sub-step, a first quantity of the glue, and then, in a second gluing sub-step, a second quantity of glue.

In accordance with another aspect of the present invention, at least one of either the first or second gluing sub-steps occurs during the rotation of the packets mounted on the transfer wheel.

DESCRIPTION OF THE DRAWINGS

These and other aspects, characteristics and advantages of the present invention will become apparent from the following description of some embodiments, given as a non-restrictive example with reference to the attached drawings wherein.

Figure 1:
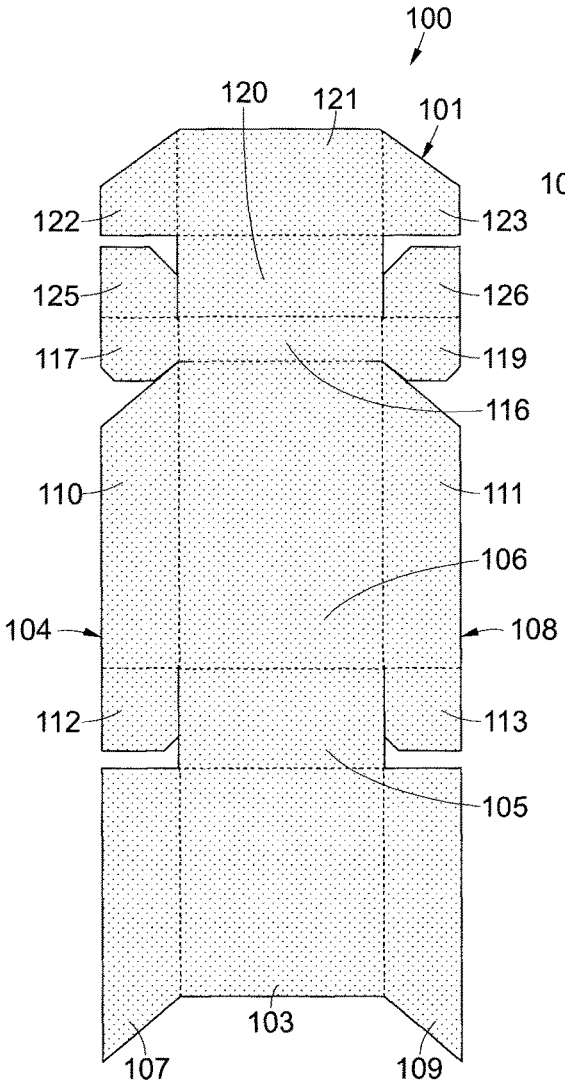
FIG. 1 is a schematic top view of a shaped element from which to obtain a packet containing smoking articles by means of an apparatus according to the present invention.

We must clarify that in the present description the phraseology and terminology used, as well as the figures in the attached drawings also as described, have the sole function of better illustrating and explaining the present invention, their function being to provide a non-limiting example of the invention itself, since the scope of protection is defined by the claims.

To facilitate comprehension, the same reference numbers have been used, where possible, to identify identical common elements in the drawings. It is understood that elements and characteristics of one embodiment can be conveniently combined or incorporated into other embodiments without further clarifications.

DESCRIPTION OF SOME EMBODIMENTS OF THE PRESENT INVENTION

Figure 4:
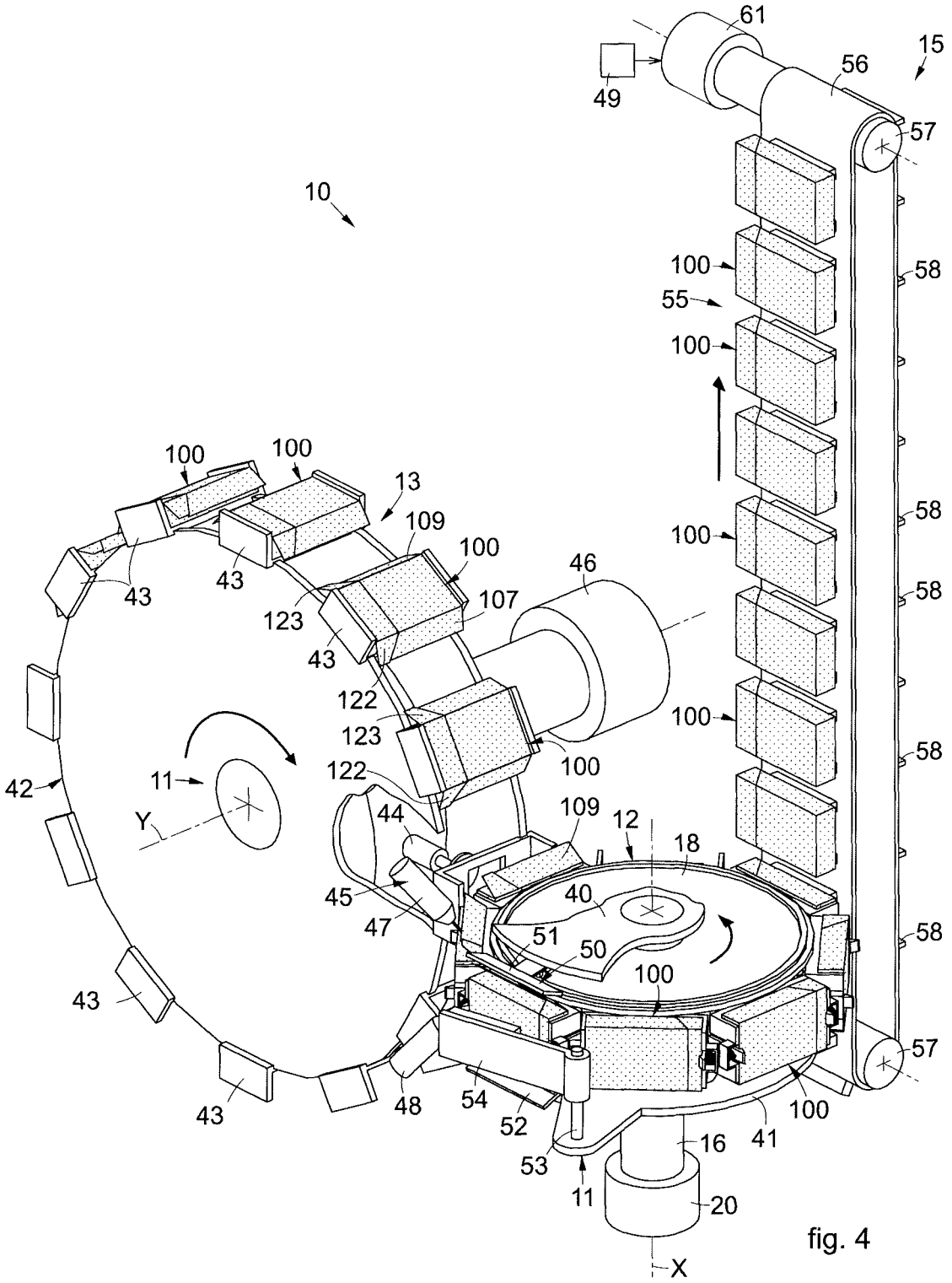
FIG. 4 is a schematic three-dimensional view of an apparatus for packaging packets of smoking articles according to the present invention.

With reference to FIG. 4, an apparatus 10 according to the present invention is configured to selectively and sequentially package packets 100 of smoking articles 200, for example cigarettes, or suchlike.

Figure 2:
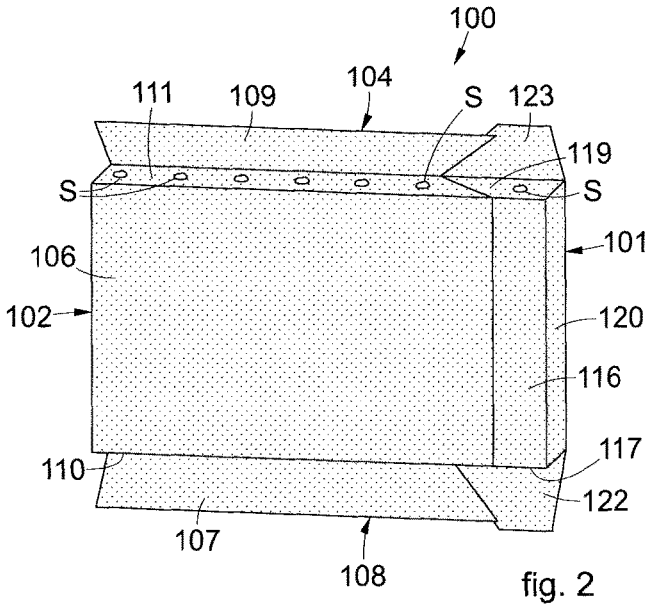
FIG. 2 is a schematic three-dimensional view of a packet in a packaging step, with the lateral flaps open and not yet glued onto the corresponding internal lateral flaps.
Figure 3:
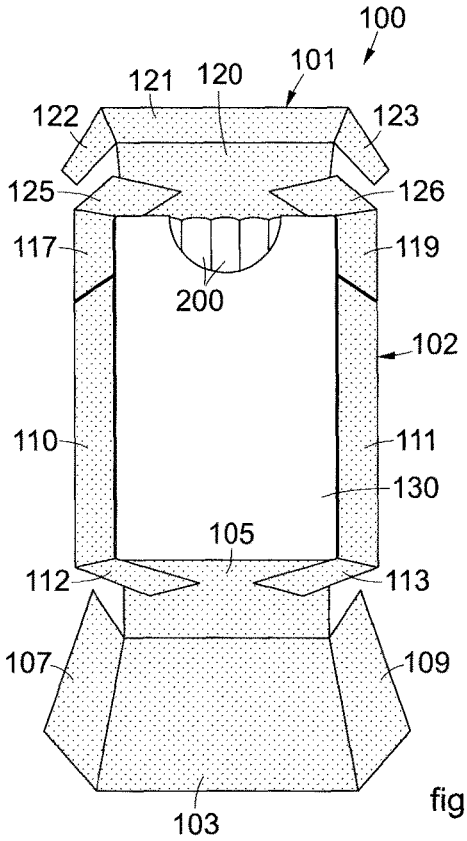
FIG. 3 is a schematic three-dimensional view of the packet of FIG. 2 containing a group of smoking articles.

Before describing the apparatus 10 in detail, an example of one of the packets 100 (FIGS. 1, 2 and 3) will now be described, by way of a non-limiting indication.

Each packet 100 is for example of the type with a lid 101 hinged on a box-like body 102, also known by the English term "hinge lid", known per se. The box-like body 102 and the lid 101 are usually obtained from a single cardboard which is shaped and folded in such a way that each packet 100 can substantially assume the shape of a parallelepiped, around which an external sheath is then wrapped, for example of transparent material, such as cellophane. Inside the box-like body 102, there is normally disposed an organized group of smoking articles 200, understood as a set of a defined number, for example 20 or 25, of smoking articles.

The box-like body 102 comprises, for example, a front wall 103, a bottom wall 105, a rear wall 106, parallel to the front wall 103, two internal lateral flaps 110 and 111 contiguous to the rear wall 106 on two opposite larger sides of the latter, two external lateral flaps 107 and 109 contiguous to the front wall 103 on two opposite larger sides of the latter and configured to each be glued on a corresponding internal lateral flap 110 and 111.

The box-like body 102 also comprises two opposite lateral walls 104 and 108, wherein the lateral wall 104 is defined by the overlap of the internal lateral flap 110 and the external lateral flap 107, and the lateral wall 108 is defined by the overlap of the internal lateral flap 111 and the external lateral flap 109.

In addition, two tabs 112 and 113 are each contiguous to a smaller side of a corresponding internal lateral flap 110 and 111 to each be folded, but not glued, against the internal surface of the bottom wall 105.

The lid 101 comprises a rear wall 116, having a larger side contiguous to a smaller side of the rear wall 106 of the box-like body 102, two internal lateral flaps 117 and 119 contiguous to the rear wall 116 on two opposite smaller sides of the latter, an upper wall 120, a front upper wall 121 and two external lateral flaps 122 and 123 contiguous to the front upper wall 121 on two opposite smaller sides of the latter and configured to each be glued on a corresponding internal lateral flap 117 and 119. Furthermore, two tabs 125 and 126 are each contiguous to an upper side of a corresponding internal lateral flap 117 and 119 to be each folded against the internal surface of the upper wall 120.

Specifically, the apparatus 10 has the function of gluing the external lateral flaps 107 and 109 of the box-like body 102 on the corresponding internal lateral flaps 110 and 111 and, at the same time, the external lateral flaps 122 and 123 of the lid 101 on the corresponding internal lateral flaps 117 and 119, as will be explained in more detail below.

With reference to FIG. 4, the apparatus 10 comprises a support structure 11, on which there is mounted a transfer wheel 12 rotatable around a first axis of rotation X, which in the example described here is vertical. Other embodiments may provide that the first axis of rotation X is horizontal, or inclined with respect to a horizontal plane.

The transfer wheel 12 comprises, substantially halfway through its thickness, a transverse plane PT, perpendicular to the first axis of rotation X.

The function of the transfer wheel 12 is to move the packets 100 along an arcuate transfer path P1 (FIGS. 5, 10 and 11), from a feed device 13 (FIG. 4) to an outlet device 15, which will both be described in more detail below. Both the feed device 13 as well as the outlet device 15 are mounted on the support structure 11 in certain fixed angular positions with respect to the transfer wheel 12.

In the example provided here, the transfer path P1 covers an angular sector of 270° of the transfer wheel 12 and, for purely illustrative purposes, an angle of 0° in correspondence with the feed device 13 is taken as a reference.

However, it is not excluded that the feed device 13 and the outlet device 15 can be angularly distanced as desired with respect to the transfer wheel 12, so that the transfer path P1 can, for example, affect a different angular sector, according to operational and functional requirements.

The transfer wheel 12 is attached to a shaft 16, which is connected to a drive member of a known type, for example a first motor 20 (FIG. 6), a stepper motor for example, and comprises a peripheral surface 17 coaxial to the first axis of rotation X and two opposite plates 18 and 19 perpendicular to the latter.

Furthermore, the transfer wheel 12 (FIG. 4), in correspondence with the peripheral surface 17, is provided with a plurality of hollow circumferential seatings 23 (FIG. 5), open toward the outside of the peripheral surface 17 and each substantially U-shaped, in order to each temporarily hold a packet 100 along the transfer path P1.

The seatings 23 are angularly disposed equidistant along the peripheral surface 17, for example distanced by an angle $\alpha$ of 45°, so that, in the embodiment described here, there are eight of them.

Figure 5:
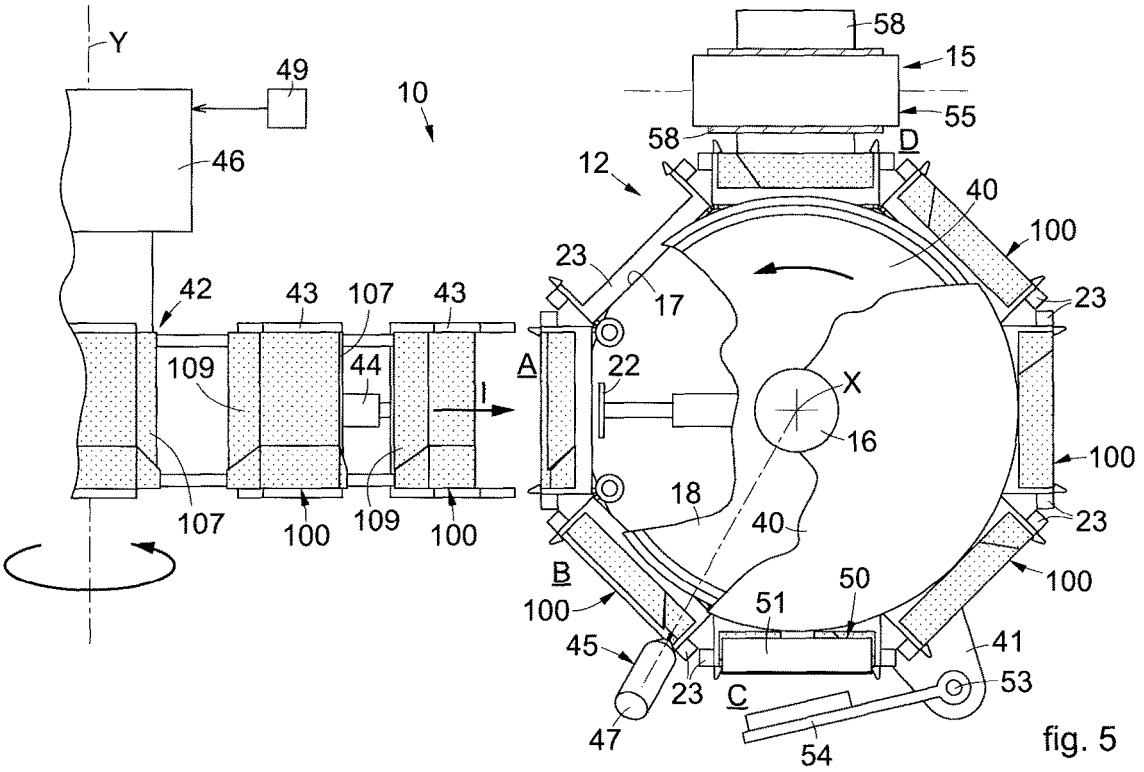
FIG. 5 is a schematic top view of the apparatus of FIG. 4.

For ease of description, and with reference to FIG. 5, in which the transfer wheel 12 is schematized as viewed from above, the following static positions are defined, in correspondence with which each seating 23 can temporarily stop: initial position, or first position A in correspondence with the feed device 13, that is, on the left in FIG. 5; intermediate angular position B oriented at 45° counterclockwise with respect to the initial position A; intermediate angular position C oriented at 45° counterclockwise with respect to position B, that is, toward the bottom of FIG. 5; and an outlet position, or second position D oriented at 270° counterclockwise with respect to the initial position A, at the end of the path P1, that is, toward the top of FIG. 5, in correspondence with which the outlet device 15 is positioned.

Figure 8:
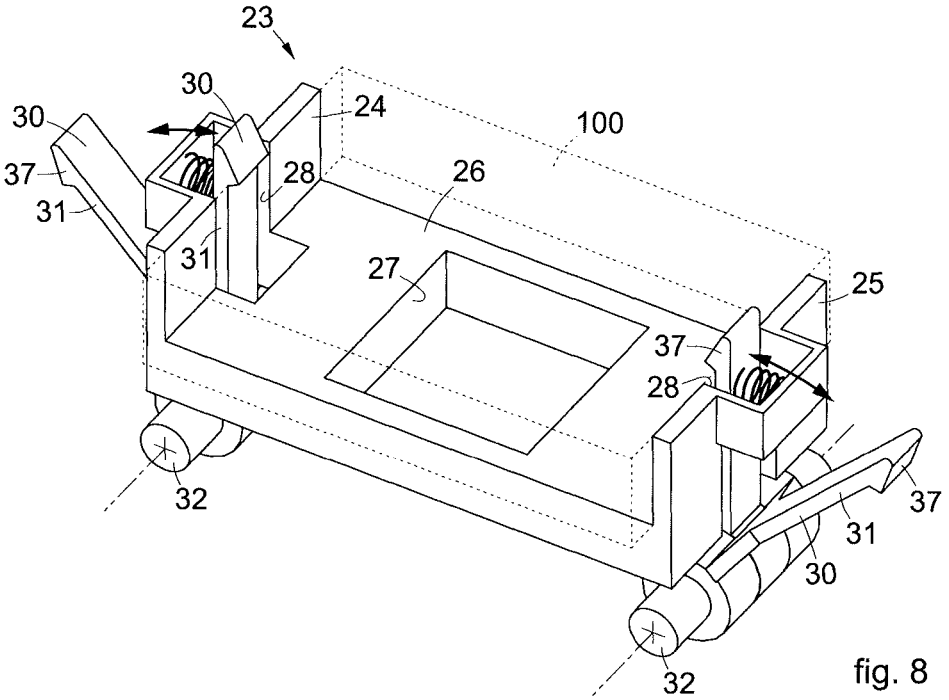
FIG. 8 is a schematic three-dimensional view, on an enlarged scale, of a detail of the apparatus of FIG. 4.
Figure 9:
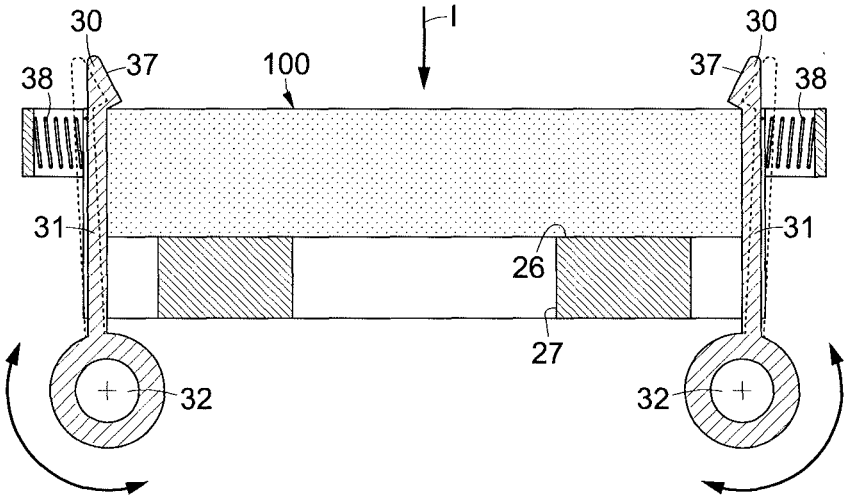
FIG. 9 is a top view of the detail of FIG. 8.

Furthermore, each seating 23 has a width substantially equal to the length of a packet 100 and comprises two lateral walls 24 and 25 (FIGS. 8 and 9), parallel to each other and orthogonal to a base wall 26, on which the rear walls 106 and 116 of a packet 100 can abut. The base wall 26 is substantially perpendicular to a radius of the transfer wheel 12, and it is provided with a central cavity 27 to allow the packets 100 to be contacted by a possible damping member 22 disposed in a central zone of the transfer wheel 12, as will be better described below.

On each lateral wall 24 and 25 there is a groove 28 perpendicular to the first axis of rotation X and in which a temporary gripping element 30 is housed, which is pivoted on a pin 32 mounted on the two plates 18 and 19, perpendicularly to them. Each element 30 has an end shaped in such a way as to have an inclined plane 31 which defines a hooking tooth 37. For each seating 23, the two inclined planes 31 of the two opposite elements 30 are specular with respect to each other in order to cooperate with the lower 105 and upper 120 walls of a packet 100. A spring 38 constantly pushes the element 30 into a rest position, in which it is parallel to the groove 28.

The distance between the two elements 30, when they are in the rest position, is such that each packet 100, when inserted in the seating 23 in a direction of insertion I (FIGS. 5 and 9) perpendicular to the base plate 26, interferes with the two inclined planes 31 so that it can cause the two elements 30 to perform a slight rotation around the pins 32, and so that the same elements 30 can then close automatically due to the action of the springs 38, so that the hooking teeth 37 can hold the packet 100 temporarily stationary in the seating 23, preventing an involuntary or accidental dissociation between the packet 100 and the corresponding seating 23.

Advantageously, in order to reduce the number of components, two elements 30 (FIGS. 8, 10 and 11) associated with two seatings 23 that are adjacent to each other are pivoted on each pin 32. In this way, the number of pins 32 is equal to the number of seatings 23, even if there are two elements 30 for each seating 23.

The feed device 13 is disposed near the transfer wheel 12, almost tangent to it, and comprises a feed wheel 42 (FIGS. 5 and 6), substantially of a known type, which is mounted on the support structure 11 so that it is selectively rotatable around a second axis of rotation Y, which in the example provided here is perpendicular to the first axis of rotation X. The feed wheel 42 is commanded by a suitable drive member, for example a second motor 46, which is also of the stepper type, for example.

The two motors 20 and 46 are controlled in any known way whatsoever, for example by means of a programmable control unit 49 (FIGS. 5 and 6), so that the feed wheel 42 and the transfer wheel 12 are rotated in a coordinated manner, as will be described in detail below.

The feed wheel 42 comprises a plurality of seatings 43 on its periphery, which are angularly equidistant from each other and configured to each receive at inlet, from one or more processing stations located upstream, which are of a type known per se and not the subject of the present invention, a packet 100 already partly packaged and containing an organized group of smoking articles 200, possibly held together by an internal wrapping 130 (FIG. 3), wherein each packet 100 still has, however, the external lateral flaps 107, 109, 122 and 123 open and therefore not glued on the corresponding internal lateral flaps 110, 111, 117 and 119, respectively.

In particular, the feed wheel 42 (FIG. 5) is configured to supply in sequence to the transfer wheel 12 the packets 100 to be completed, for example by means of one or more subsequent processes, such as for example the gluing of the external lateral flaps 107, 109, 122 and 123 on the corresponding internal lateral flaps 110, 111, 117 and 119, respectively, by inserting, one at a time, each packet 100 in the seating 23 which is temporarily located in the initial position A.

The feed device 13 also comprises a thruster 44, installed inside a central cavity of the feed wheel 42 and configured to selectively thrust the packets 100 radially toward the outside, that is, toward the seating 23 of the packet transfer wheel 12 (FIG. 4) which is temporarily located in the initial position A.

The damping member 22 is opposed to the thruster 44 and is configured to selectively cooperate with the front wall 103 of a packet 100 arriving from the feed wheel 42, before the same packet 100 is precisely placed in the seating 23 which is temporarily located in correspondence with the initial position A.

In possible alternative embodiments, not shown in the drawings, the feed device 13 could be made in another way; for example it could comprise a conveyor belt that performs the functions of the feed wheel 42.

The apparatus 10 also comprises a gluing device 45 mounted on the support structure 11 and disposed in the proximity of the peripheral surface 17 of the transfer wheel 12, advantageously in a fixed angular position with respect to the latter, between the feed device 13 and the outlet device 15, along the transfer path P1. The gluing device 45 is configured to selectively deliver at least one glue on the internal lateral flaps 110, 111, 117 and 119 of the packets 100.

In particular, the gluing device 45 is advantageously installed substantially in correspondence with position B, although it can be disposed in another fixed angular position, between the feed device 13 and the outlet device 15, along the transfer path P1, as a function of other operational choices.

The gluing device 45 comprises a pair of delivery devices 47 and 48, of a known type, located in the proximity of the peripheral surface 17 and inclined on opposite parts with respect to the plates 18 and 19 of the transfer wheel 12, converging toward the transverse plane PT. The delivery device 47 is configured to selectively deliver at least one adhesive material, or more simply a glue, between the internal lateral flaps 110 and 117 and the external lateral flaps 107 and 122, while the delivery device 48 is configured to selectively deliver at least one glue between the internal lateral flaps 111 and 119 and the external lateral flaps 109 and 123. For example, the glue can be delivered in spots or continuously, and deposited on the internal lateral flaps 110, 111, 117 and 119.

The delivery devices 47 and 48 can be of the type capable of delivering jets of glue in a punctiform manner, or in points S (FIGS. 2 and 11) which are distanced from each other, or in continuous strips or lines of glue, and they can comprise glue jet delivery means, nozzles, guns, syringes, or similar glue delivery members.

The type of glue is advantageously of the rapid-setting type and can be either of the hot or cold type, or a combination thereof. The delivery devices 47 and 48 can all be provided to deliver the same type of glue, or different types of glue. With the delivery devices 47 and 48 there are associated pumping means of a known type and not shown in the drawings, which control the selective delivery of the glue.

The delivery of the glue by the delivery devices 47 and 48 is also controlled by the control unit 49.

In accordance with one characteristic of the present invention, the gluing device 45, although positioned in a fixed angular position with respect to the transfer wheel 12, is able to move radially with respect to the latter in order to define, as desired, the shape of deposition of the glue on the internal lateral flaps 110, 111, 117 and 119, and in particular the internal lateral flaps 110 and 111, which are relatively long, indicatively about 10 cm. One possible choice is to obtain a rectilinear disposition R, that is, parallel to a larger side of each of the internal lateral flaps 110 and 111.

Furthermore, the gluing device 45 comprises a movement device 60 (FIGS. 10 and 11) controlled by the control unit 49 to selectively move the delivery devices 47, 48 along a path P2 that is substantially radial with respect to the first axis of rotation X, in order to compensate for the arcuate path P1 that each packet 100 follows. The movement device 60 can be of any known type whatsoever, such as for example an electric motor, a glyph, an eccentric member, a pendulum, an oscillating arm, or a linear actuator. Therefore, the movement device 60 can move the gluing device 45 in order to move it closer to or away from the first axis of rotation X, in coordination with the rotation of the transfer wheel 12, as will be described in detail below.

Furthermore, the apparatus 10 comprises a pressing device 50, mounted on the support structure 11 in a fixed angular position with respect to the transfer wheel 12, in particular downstream of the gluing device 45 along the arcuate path P1, that is, substantially in position C (FIG. 5). The pressing device 50 is configured to selectively fold the external lateral flaps 107, 109, 112 and 123 respectively toward the internal lateral flaps 110, 111, 117 and 119 of the packet 100, which are already provided with the glue deposited by the gluing device 45.

The pressing device 50 comprises a pair of pressing members, upper 51 and lower 52, respectively, which are mounted one on an upper plate 40 of the support structure 11 and the other on a lower plate 41 thereof. The two plates 40 and 41 are parallel to the plates 18 and 19 of the transfer wheel 12.

Each of the two pressing members 51 and 52 is commanded by at least one actuator of a known type and not shown in the drawings, which is capable of moving it selectively, under the control of the control unit 49, between a rest position, in which it is distanced from the corresponding external lateral flaps 109, 123/107, 122, and an operating position, in which it thrusts the latter against the corresponding internal lateral flaps 111, 119/110, 117.

Thus, the upper pressing member 51 is configured to selectively fold the external lateral flaps 109 and 123 onto the internal lateral flaps 111 and 119, and the lower pressing member 52 is configured to selectively fold the external lateral flaps 107 and 122 onto the internal lateral flaps 110 and 117.

Furthermore, the pressing device 50 comprises a mobile arm 53, mounted on the plate 41 and commanded together with the pressing members 51 and 52, possibly by the same actuator as above or by another autonomous actuator, of a known type and not shown in the drawings, which is also possibly controlled by the control unit 49, in order to take one end 54 of the mobile arm 53 selectively in contact with the rear wall 106 of the packet 100 which is located in correspondence with position C.

The outlet device 15 (FIG. 4) comprises pick-up means, which in the example given here comprise a pick-up device 55 and are configured to pick up the packets 100 selectively and sequentially from the transfer wheel 12 and possibly transport them toward other processing stations, not shown in the drawings and not the subject of the present invention, which, for example, can comprise a station for applying a stamp, a station for covering, by means of cellophane, the already glued packet 100, a packaging station, or other.

The pick-up device 55 comprises, for example, a conveyor belt 56, mounted on two rollers 57 and which, in the example described here, is parallel to the first axis of rotation X, that is, vertical.

At least one of the rollers 57, for example the upper one, is connected to a drive member, for example a third motor 61, also of the stepper type for example, and controlled by the control unit 49, so that the conveyor belt 56 is made to advance selectively, as will be described in detail below.

The pick-up device 55 comprises a plurality of pick-up teeth 58, configured to come in contact with the external lateral flap 109 already glued to the corresponding internal lateral flap 111 of each packet 100, and then push the latter from the bottom upward, extracting it from the elements 30 which hold it in the seating 23, without interfering with the elements 30 themselves.

The operation of the apparatus 10 described heretofore, which corresponds to the method according to the present invention, comprises the following steps.

To illustrate the operation of the apparatus 10 as a whole, for simplicity of explanation, the following describes the processing cycle on a single packet 100, it being applicable to all packets 100.

Figure 6:
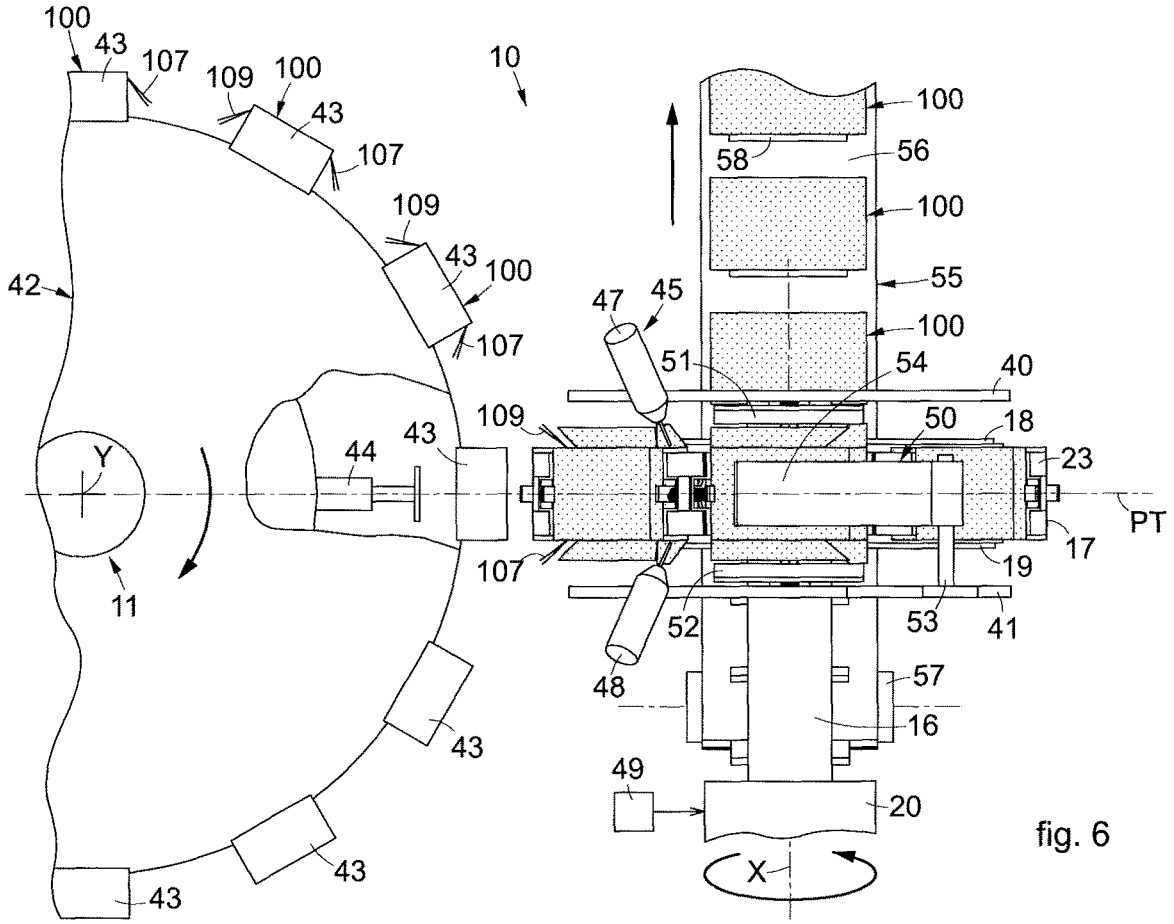
FIG. 6 is a schematic front view of the apparatus of FIG. 4.

In a first processing step, a plurality of packets 100 to be completed (FIG. 3) are inserted sequentially into the seatings 43 of the feed wheel 42, for example automatically. In particular, each packet 100 to be completed is inserted in the respective seating 43 so that its walls 106 and 116 are in contact with the base of the latter, the smoking articles are parallel to the second axis of rotation Y, and the external lateral flaps 107, 109, 122 and 123 are open and facing toward the feed wheel 42 (FIGS. 4 and 6).

The feed wheel 42 is rotated, for example stepwise by the second motor 46, in a clockwise direction, until one of the seatings 43 containing a packet 100 to be completed is located exactly in correspondence with the seating 23 of the transfer wheel 12 which is in the initial position A (FIG. 5).

The feed wheel 42 is stopped temporarily the moment it reaches this angular position, and at the same time the transfer wheel 12 is also stopped, so that, for a certain first predetermined period of time T1, for example of about 50 ms, both the transfer wheel 12 as well as the feed wheel 42 are stationary, with one of the seatings 23 of the former exactly opposite a seating 43 of the latter.

At this point, the thruster 44 (FIG. 6) is activated to radially thrust the packet 100 which is in front of it outward, in order to transfer it from the seating 43 of the feed wheel 42 to the seating 23 of the transfer wheel 12 (initial position A in FIG. 5). At the same time, the damping member 22 is also activated, accompanying the packet 100 during its insertion into the seating 23.

In order to enter the seating 23, the packet 100 automatically opens the two corresponding elements 30, against the action of their springs 38, and is therefore held by the gripping teeth 37 against the base wall 26 of the same seating 23. In this position, the external lateral flaps 107, 109, 122 and 123 are facing toward the outside of the transfer wheel 12 and on opposite parts with respect to the transverse plane PT. After this, the thruster 44 and the damping member 22 are returned to their starting position.

Then, both the feed wheel 42 and also the transfer wheel 12 are rotated for a predetermined second period of time T2, for example of 50 ms.

In particular, during this second period of time T2 the transfer wheel 12 performs a rotation, for example of an angular step equal to 45° in an anticlockwise direction (FIG. 5), and thus takes the seating 23 containing the packet 100, which we are taking into consideration, in correspondence with position B.

At the same time, the feed wheel 42 also performs a rotation in a clockwise direction, for example of one step, until the subsequent seating 43 moves in front of the seating 23 of the transfer wheel 12 which is in the initial position A. Furthermore, the seating 23 adjacent to the first will be moved to position A, in this way the latter will be able to radially receive a subsequent packet 100 from the feed wheel 42, so that the cycle previously described can be repeated.

The rotations of the transfer wheel 12 and of the feed wheel 42 are advantageously coordinated by the control unit 49, so that one step of the transfer wheel 12 corresponds to one step of the feed wheel 42, even if the angular step of one of the two wheels 12 or 42 could be different from that of the other wheel 42 or 12.

In position B, the gluing device 45 is ready to inject the glue, by means of the delivery devices 47 and 48, first on the internal lateral flaps 117 and 119 of the lid 101 and then on the internal lateral flaps 110 and 111 of the box-like body 102, possibly after a pause, for example of a few milliseconds. In particular, the glue can be delivered on the internal lateral flaps 117 and 119 while the transfer wheel 12 is stationary and on the internal lateral flaps 110 and 111 when the latter is in motion.

According to one embodiment of the present invention, the gluing device 45 can be programmed to initially deliver, in a first gluing step, for example in the first of the points S (FIG. 10), or in the single point S, a first predetermined quantity Q1 of glue on each of the flaps 117 and 119. Subsequently, while the transfer wheel 12, by rotating, displaces the packet 100 from position B to the subsequent position C, in a second gluing step, a second predetermined quantity Q2 of glue is delivered on the internal lateral flaps 110 and 111.

Therefore, while the second gluing step can advantageously occur when the transfer wheel 12 is rotating, the first gluing step can occur both when the transfer wheel 12 is temporarily stationary and also when the latter is rotating, or is starting to rotate after a temporary stop.

Figure 10:
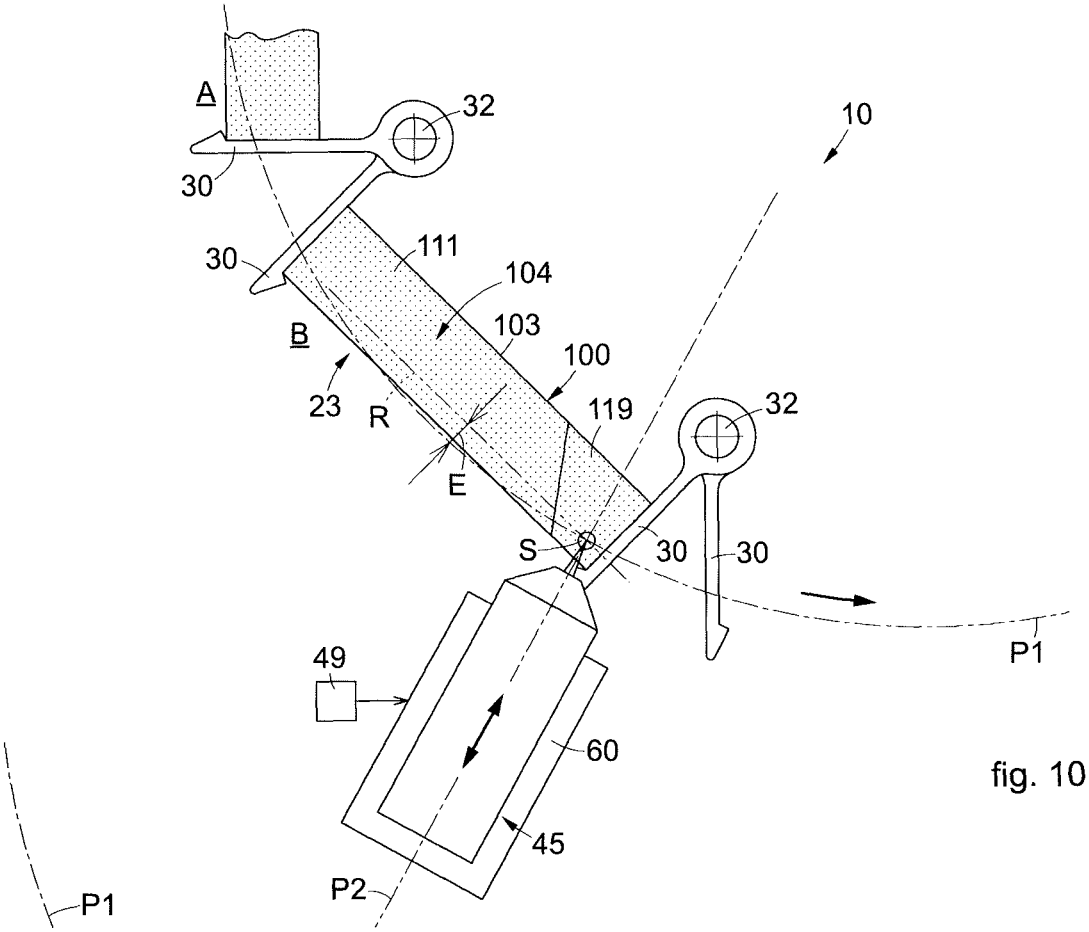
FIG. 10 is a partial and schematic view of the apparatus of FIG. 4 in a first operating condition.
Figure 11:
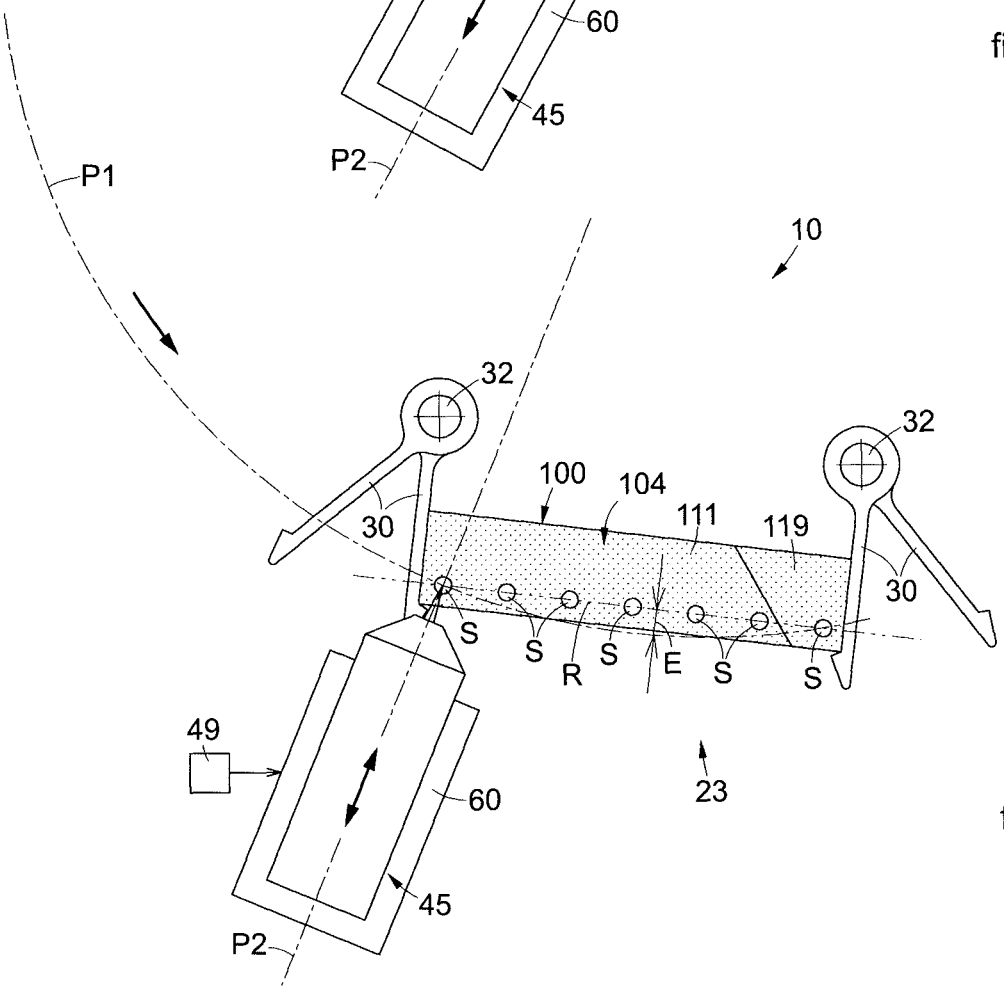
FIG. 11 is a partial and schematic view of the apparatus of FIG. 4 in a second operating condition.

In any case, the movement device 60, in coordination with the rotation/stop of the transfer wheel 12, is capable of moving the gluing device 45 radially closer to or away from the first axis of rotation X, in order to deliver the glue with a programmed disposition R, for example linear and parallel to an edge of the internal lateral flap 110, 111, compensating for the radial distance E that exists at the center of the rectilinear disposition R with respect to the arcuate path P1 (FIGS. 10 and 11).

The excursion or radial distance E could have a value comprised between 1.5 mm and 5 mm, for example.

One embodiment could provide, for example, that the certain radial position of the gluing device 45 is such that the two delivery devices 47 and 48 face toward any one point whatsoever along the length of the packet 100 when the latter is in position B. In this way, the delivery devices 47 and 48 could deliver the first quantity Q1 of glue on the internal lateral flaps 110, 111, 117 and 119 of the packet 100 during the latter's movement from the initial position A to position B. For example, said point could be located in correspondence with the internal lateral flap 119 of the lid 101 of the packet 100 (FIGS. 10 and 11).

Subsequently, the transfer wheel 12 is made to rotate further, for example by an angular step equal to 45° in an anticlockwise direction, until the seating 23 containing the packet 100 is in correspondence with position C.

In position C, the packet 100, on which the glue has already been delivered in correspondence with its internal lateral flaps 110, 111, 117 and 119, is still with the external lateral flaps 107, 109, 122 and 123 open as described above, and it is located exactly in correspondence with the pressing device 50.

While the transfer wheel 12 is stationary, the pressing members 51 and 52 are selectively moved by the corresponding actuators, which are controlled by the control unit 49, so that the upper pressing member 51 folds the external lateral flaps 109 and 123 taking them in contact with the internal lateral flaps 111 and 119 on which the glue has already been delivered, and the lower pressing member 52 folds the external lateral flaps 107 and 122 taking them in contact with the internal lateral flaps 110 and 117 on which the glue has already been delivered.

In this way, the external lateral flaps 109 and 123 are glued to the internal lateral flaps 111 and 119 and the external lateral flaps 107 and 122 are glued to the internal lateral flaps 110 and 117.

At the same time, the mobile arm 53 is also activated, which takes its end 54 in contact with the rear wall 106 of the packet 100 so that the latter does not deform during this step.

After this, the pressing members 51 and 52 and the end 54 are taken back into position, either automatically by means of return members of a known type and not shown in the drawings, or commanded by the respective actuators.

Subsequently, the transfer wheel 12 is made to rotate by the first motor 20 in a sequential manner, for example stepwise, with angular steps equal to 45°, which in the example given here are four, until the seating 23 containing the packet 100, with the external lateral flaps 109, 123, 107 and 122 already glued to the internal lateral flaps 111, 119, 110 and 117, respectively, is located in correspondence with position D.

Each rotation of the transfer wheel 12 is alternated with periods of stop time T1, in order to allow the gluing cycles to be repeated for other packets 100, which are the same as the one described above for a single packet 100.

Figure 7:
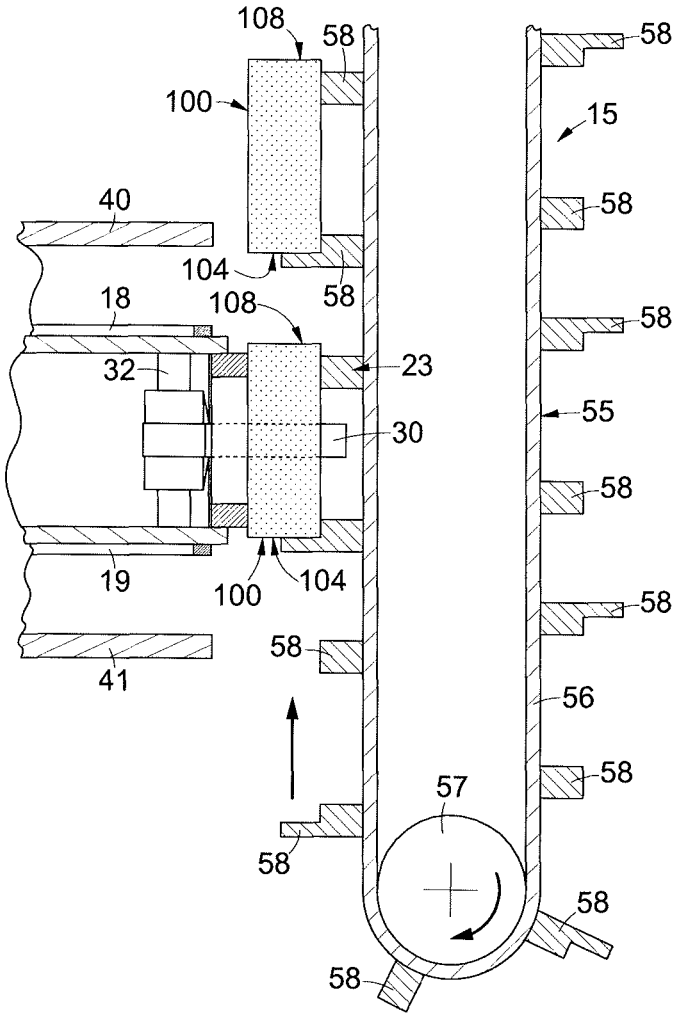
FIG. 7 is a partial and schematic lateral view of the apparatus of FIG. 4.

When the transfer wheel 12 is stationary in position D, the packet 100 is exactly in correspondence with the outlet device 15 (FIGS. 4 and 7).

At this point, the control unit 49 commands the third motor 61 (FIG. 4) to rotate the rollers 57 and consequently make the conveyor belt 56 advance by one step in the clockwise direction (FIG. 7).

The rotation of the conveyor belt 56 causes one of its pick-up teeth 58 to come in contact with the external lateral flap 109 of the packet 100 and then thrust the latter vertically, from the bottom upward, taking it toward subsequent stations such as, for example, a station for applying a stamp, a station for covering, by means of cellophane, the already glued packet 100, a packaging station, or other.

In this way, the seating 23 which is in correspondence with position D will be empty and ready to receive a subsequent packet 100 from the feed wheel 42 in a subsequent processing cycle, the same as the one described heretofore, when it will once again be in the initial position A, with angular steps equal to 45°, which in the example given here are two.

Therefore, the total time T3 taken by the transfer wheel 12 to make a complete revolution around its axis of rotation X is equal to the number of seatings 23 (which in the example given here are eight) multiplied by the time T1+T2, that is, approximately 800 ms. During the total time T3 the apparatus 10 is therefore able to glue eight packets 100, as described above, so that the hourly productivity is 36,000 packets/hour.

The apparatus 10 therefore achieves the purposes of the present invention, resolving the corresponding technical problem in a new and original way.

It is clear that modifications and/or additions of parts may be made to the apparatus 10 and to the method as described heretofore, without departing from the field and scope of the present invention, as defined by the claims.

It is also clear that, although the present invention has been described with reference to some specific examples, a person of skill in the art shall certainly be able to achieve many other equivalent forms of apparatuses and methods for packaging packets of smoking articles, having the characteristics as set forth in the claims and hence all coming within the field of protection defined thereby.

In the following claims, the sole purpose of the references in brackets is to facilitate their reading and they must not be considered as restrictive factors with regard to the field of protection defined by the same claims.

The invention claimed is:

1. Apparatus for packaging packets of smoking articles, wherein each of said packets comprises a box-like body having at least two opposite lateral walls, each lateral wall being formed by at least one respective internal flap and at least one external flap, which are overlapping each other and able to be glued together, said apparatus comprising:

a transfer wheel selectively rotatable around a first axis of rotation and configured to move said packets along an arcuate transfer path, wherein said transfer wheel circumferentially comprises a peripheral surface provided with a plurality of seatings, each of which is configured to temporarily hold one of said packets along said transfer path;

a feed device disposed in a first fixed angular position with respect to said transfer wheel at the beginning of said transfer path and configured to individually feed packets to be glued toward said seatings;

an outlet device disposed in a second fixed angular position with respect to said transfer wheel at an end of said transfer path and configured to receive said packets, after the packets have been glued, coming from said transfer wheel;

a gluing device disposed outside said transfer wheel in an intermediate angular position between said feed device and said outlet device, and configured to selectively deliver a glue on said packets to be glued, wherein each of said seatings is oriented so that, in said seating, a respective packet to be glued is disposed along said transfer path with the respective internal flaps of each lateral wall disposed perpendicular to said first axis of rotation, wherein said apparatus also comprises a movement device configured to move said gluing device along a path substantially radial with respect to said transfer wheel, taking said gluing device closer to, or away from, said peripheral surface, in coordination with the rotation of said transfer wheel, in order to deliver said glue on at least one of either said internal flap or the corresponding external flap of each lateral wall of the packet to be glued when the packet passes in front of said gluing device, the movement of said gluing device being adjusted in such a way as to deposit said glue along a programmed disposition while said packet to be glued advances along said transfer path.

2. Apparatus as in claim 1, wherein said programmed disposition is substantially rectilinear and parallel to an edge of said lateral walls, and said movement device is capable of compensating for the radial distance that exists between said rectilinear programmed disposition and said arcuate transfer path.

3. Apparatus as in claim 1, wherein said gluing device is configured to deliver, in a first gluing step, a first quantity of said glue, and then after a pause, in a second gluing step, a second quantity of said glue.

4. Apparatus as in claim 1, wherein said gluing device comprises a pair of delivery devices and, disposed in the proximity of said peripheral surface, on opposite parts with respect to a transverse plane of said transfer wheel, perpendicular to said first axis of rotation, and in that said delivery devices and are convergent toward said transverse plane.

5. Apparatus as in claim 1, wherein said feed device comprises a feed wheel adjacent to said transfer wheel, substantially tangent thereto and rotatable around a second axis of rotation perpendicular to said first axis of rotation.

6. Apparatus as in claim 1, wherein each of said seatings is substantially U-shaped, and in that said outlet device comprises at least one pick-up device configured to pick up said packets selectively and sequentially one at a time from said transfer wheel, removing them from said seatings preferably from the bottom upward along a rectilinear path substantially parallel to said first axis of rotation.

7. Apparatus as in claim 1, further comprising at least one pressing device disposed outside said transfer wheel in another intermediate angular position between said gluing device and said outlet device, and configured to selectively press said external lateral flaps against the corresponding internal lateral flaps of said packets in order to glue them together.

8. Method for packaging packets of smoking articles, wherein each of said packets comprises a box-like body having at least two opposite lateral walls, each lateral wall being formed by at least one respective internal flap and at least one external flap able to be glued together, said method comprising the following steps:

a movement step, in which a transfer wheel, selectively rotatable around a first axis of rotation, is selectively rotated in order to move said packets along an arcuate transfer path, from a feed device, located in a first fixed angular position, to an outlet device, located in a second fixed angular position, and a gluing step in which a gluing device, disposed outside said transfer wheel in an intermediate angular position between said feed device and said outlet device, selectively delivers at least one glue on said packets to be glued, each packet to be glued being disposed along said transfer path with the respective internal flaps of each lateral wall disposed perpendicular to said first axis of rotation; wherein during said gluing step said gluing device is moved along a path substantially radial with respect to said transfer wheel, taking said gluing device closer to, or away from, said transfer wheel, in coordination with the rotation of said transfer wheel, in order to deliver said glue between at least each one of said internal lateral flaps and the corresponding external lateral flaps of the packet when the packet passes in front of said gluing device, the movement of said gluing device being adjusted in such a way as to deposit said glue along a programmed disposition while said packet to be glued advances along said transfer path.

9. Method as in claim 8, wherein said programmed disposition is substantially rectilinear and parallel to an edge of said lateral walls, and said movement device compensates for the radial distance that exists between said rectilinear programmed disposition and said arcuate transfer path.

10. Method as in claim 8, wherein said gluing device delivers, in a first gluing sub-step, a first quantity of said glue, and then after a pause, in a second gluing sub-step, a second quantity of said glue.

11. Method as in claim 10, wherein at least one of either said first or second gluing sub-steps occurs during the rotation of said packets mounted on said transfer wheel.

* * * * *